United States Patent [19]

Smith

[11] Patent Number: 4,687,555

[45] Date of Patent: Aug. 18, 1987

[54] APPARATUS FOR SELECTIVELY PLATING ELECTRICAL TERMINALS

[75] Inventor: Mark L. Smith, Harrisburg, Pa.

[73] Assignee: AMP Incorporated, Harrisburg, Pa.

[21] Appl. No.: 929,044

[22] Filed: Nov. 10, 1986

[51] Int. Cl.[4] ..... C25D 5/02; C25D 17/00

[52] U.S. Cl. ..... 204/26; 204/224 R

[58] Field of Search ..... 204/26, 224 R

[56] References Cited

U.S. PATENT DOCUMENTS

| | | | |
|---|---|---|---|
| 4,384,926 | 5/1983 | Wagner | 204/26 |
| 4,427,498 | 1/1984 | Wagner | 204/26 |
| 4,555,321 | 11/1985 | Wicks | 204/224 R |

*Primary Examiner*—T. M. Tufariello

*Attorney, Agent, or Firm*—Katherine A. Nelson

[57] ABSTRACT

An apparatus for plating interior surfaces of essentially flat electrical terminals that are spaced apart and attached to a carrier strip is disclosed. The apparatus is comprised of strip feeding means which feeds the strip (120) of terminals (122) to a rotating mandrel (10) which guides the terminals (122) through a plating zone while they are plated, a source of electrolytic plating solution, and a source of electrical potential for applying electrical current flow from the anode (42) through the solution to a cathode. The mandrel (10) has a plurality of nozzles (62) located about its axis of rotation, and a plurality of anode extensions (64), each anode extension (64) being mounted in an associated nozzle (62), such that one end of the anode extension (64) protrudes outwardly from the end of the nozzle (62). The strip (120) of terminals is fed to the mandrel (10) so that the interior contact zone (128) of the terminals (122) are aligned with and mounted over the protruding end of the corresponding anode extensions (64). A conduit (56) supplies electrolyte solution under pressure through the nozzles (62) and into the terminals (122) in which the associated anode extensions (64) have been received. The terminals (122) are removed from the anode extensions (64) as the strip (120) exits the mandrel (10).

7 Claims, 6 Drawing Figures

APPARATUS FOR SELECTIVELY PLATING ELECTRICAL TERMINALS

FIELD OF THE INVENTION

The present invention relates to selective electroplating of electrical terminals, i.e., electroplating only the electrical contact surfaces of the terminals to the exclusion of other surfaces of the terminals and, in particular, to selectively plating terminals that are attached to a carrier strip.

BACKGROUND OF THE INVENTION

In one method of manufacturing electrical terminals, the terminals are stamped and formed from metal strip and are attached to a carrier strip. This carrier strip is useful for strip feeding the terminals through successive manufacturing operations. One necessary manufacturing operation involves plating, i.e., electroplating the electrical contact surfaces of the strip fed terminals with a contact metal, usually noble metals or noble metal alloys. These metals are characterized by good electrical conductivity and little or no formation of oxides that reduce the conductivity. Therefore, these metals, when applied as plating, will enhance conductivity of the terminals. The high cost of these metals has necessitated precision deposition on the contact surfaces of the terminals, and not on surfaces of the terminals in which plating is unnecessary.

Apparatus for plating is called a plating cell and includes an electrical anode, an electrical cathode comprised of the strip fed terminals, and a plating solution, i.e., an electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the terminals. The metal ions deposit as metal plating on those terminal surfaces in contact with the plating solution.

There are disclosed in U.S. Pat. Nos. 4,384,926, 4,427,498 and 4,555,321, owned by this Assignee, plating apparatii in which the interior surfaces of strip fed terminals can be plated by supplying plating fluid through nozzles and over associated anode extensions that are mounted for reciprocation into and out of the interiors of terminals. In the first two patents, the anode extensions are mounted within their associated nozzles. In the third patent, the anode extensions are mounted separately and apart from the nozzles and enter the terminals from a different direction than that of the plating fluid.

The apparatii disclosed in the three referenced patents are designed to be used with stamped and formed terminals, wherein the contact zone is located inside the formed terminal. To selectively plate the contact zone the anode extension must be moved inside the terminal and preferably to the center of the formed terminal. The distance traveled by the anode extension, therefore, is greater than the thickness of the stock material.

The above apparatii, however, present problems when used to plate strips of essentially flat terminals whose contact zones are located on surfaces that are perpendicular to the length of a strip, such as between the tines of a forked terminal. The depth of the contact zone for such a terminal is essentially equal to the thickness of the stock material. The center of the contact zone, therefore, would be half of the thickness of the material. Moving the anode extensions through such a short travel distance has been found to be unsatisfactory owing to dimensional and tolerance requirements.

It is an object of the present invention to provide an apparatus for selectively plating strips of stamped terminals.

It is a further object of the present invention to provide an apparatus wherein essentially only the contact zone of each terminal in a strip of terminals is plated.

It is an additional object of the present invention to provide an anode extension in the contact zone of each terminal as the terminals are plated.

Additionally, it is an object of the invention to provide a means for positioning the anode extension in the contact zone.

It is also an object of the invention to provide an apparatus that can be readily adapted to terminals having different center line spacings.

It is another object of the invention to provide a process for plating interior surfaces of flat terminals.

SUMMARY OF THE INVENTION

The mandrel apparatus in accordance with the invention is characterized in that the mandrel is rotated continuously as a strip of stamped electrical terminals is fed continuously to the mandrel partially wrapped against the mandrel, and fed from the mandrel.

The present invention is directed to selectively plating the contact zone of essentially flat terminals, that is, terminals that have been stamped from a strip of stock but do not require forming. One example of such a terminal is a forked terminal having spaced apart tines, the contact zone being between the tines. The depth of the contact zone, therefore, is equal to the thickness of the stock, typically from 0.0088 to 0.025 inches thick. The distance a movable anode would have to travel to the center of the contact zone, would be half the thickness of stock.

The mandrel has a plurality of nozzles located around the mandrel's axis of rotation. The mandrel further has an anode having a plurality of anode extensions, the anode extensions being mounted within an associated nozzle of the mandrel. The strip of terminals is fed to the mandrel such that the contact zones of the terminals are in alignment with and surround an anode extension. A conduit supplies plating solution under pressure to the nozzles, over the nozzle's associated anode extension and into the contact zone of the terminal. A source of electrical potential supplies electrical current which flows from the anode, through the anode extensions and plating solution to the interior of the terminals, the strip of terminals being the cathode. The contact zones of the terminals are removed from the anode extensions as the strip is moved off of the wheel and out of the plating zone.

A better understanding of the invention is obtained by way of example from the following description and the accompanying drawings, wherein:

DETAILED DESCRIPTION OF THE DRAWINGS

Figure 1:
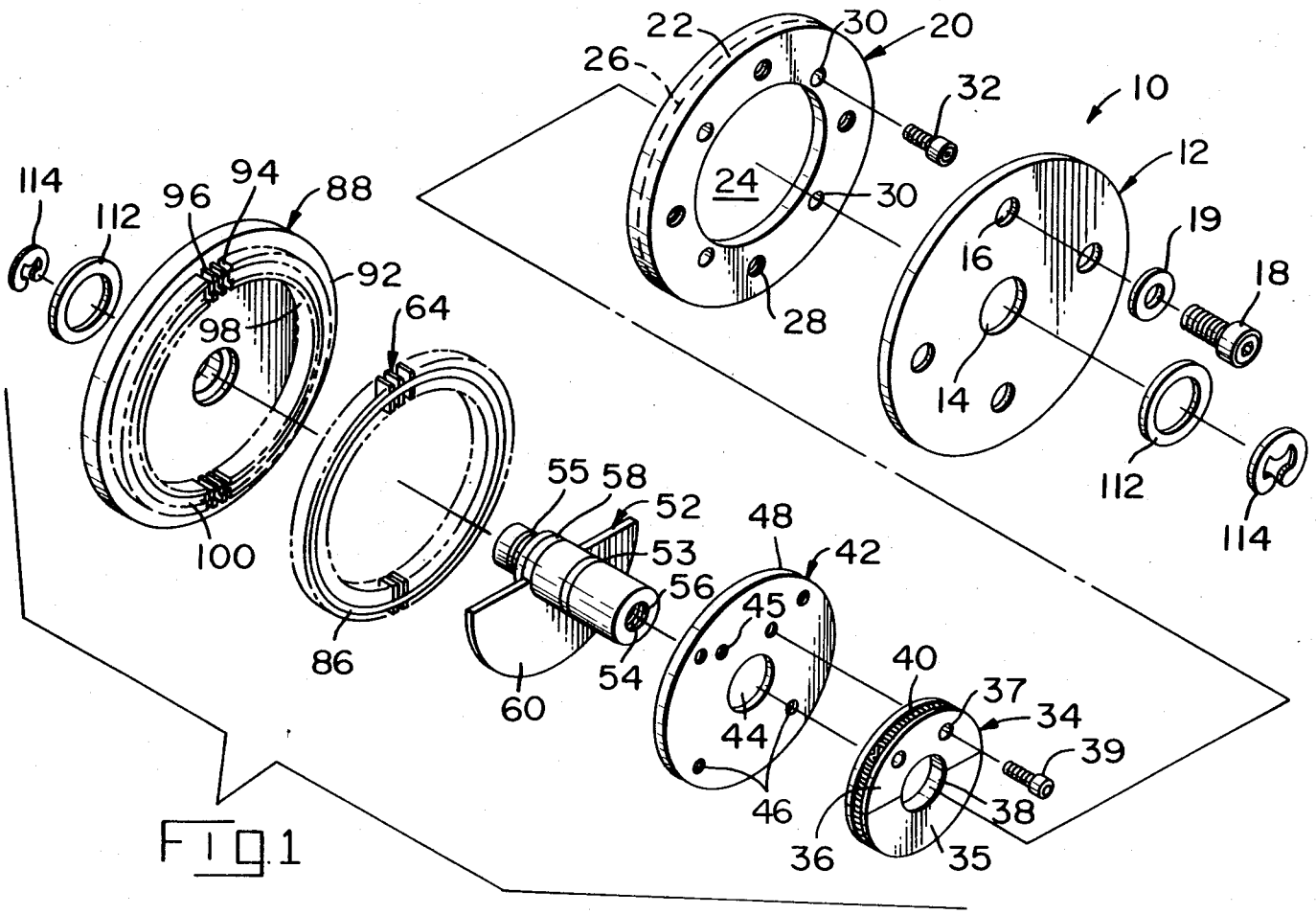
FIG. 1 is a perspective view of the apparatus for continuously plating the interior surfaces of electrical terminals according to the invention with parts of the apparatus exploded.
Figure 2:
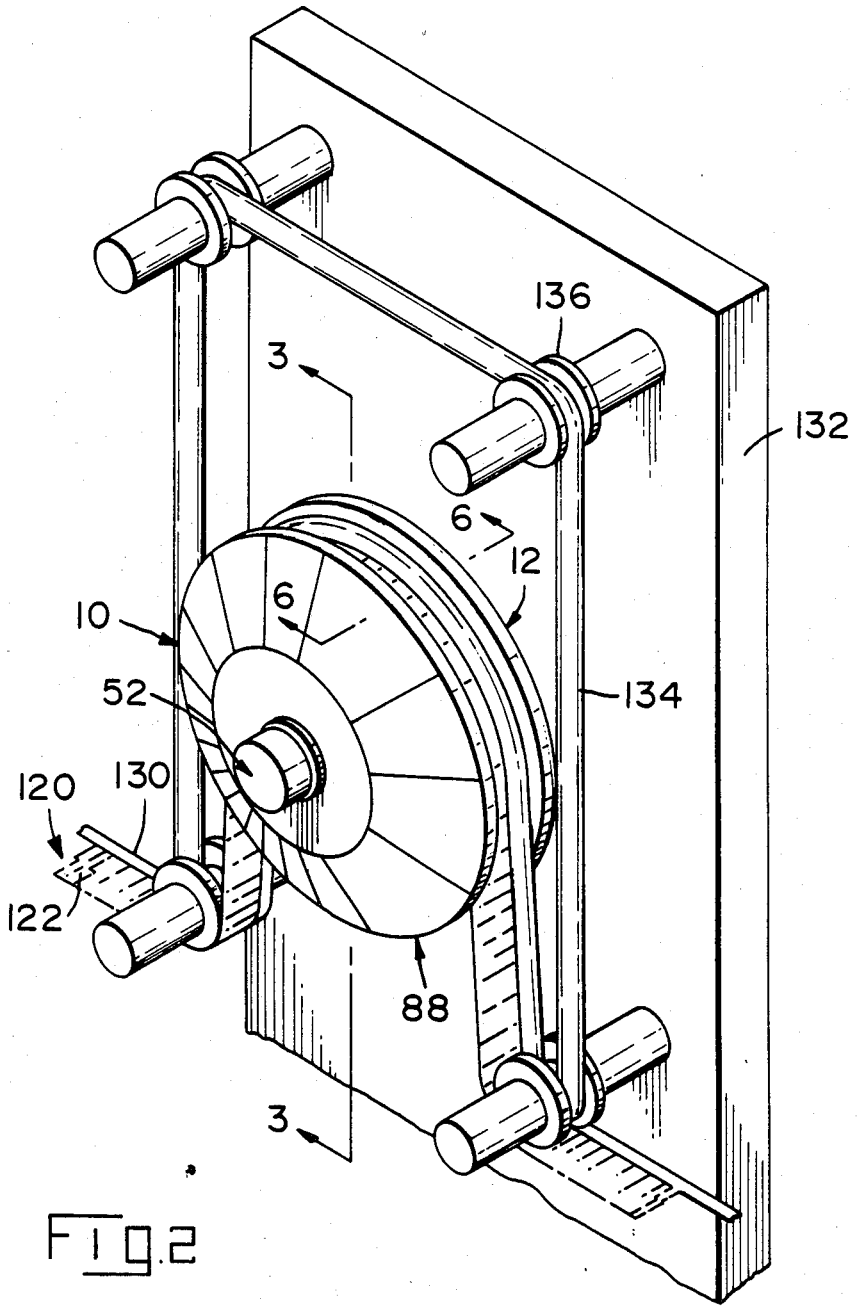
FIG. 2 is a perspective view of the assembled apparatus shown in FIG. 1 combined with a belt mechanism for feeding the strip of terminals.
Figure 3:
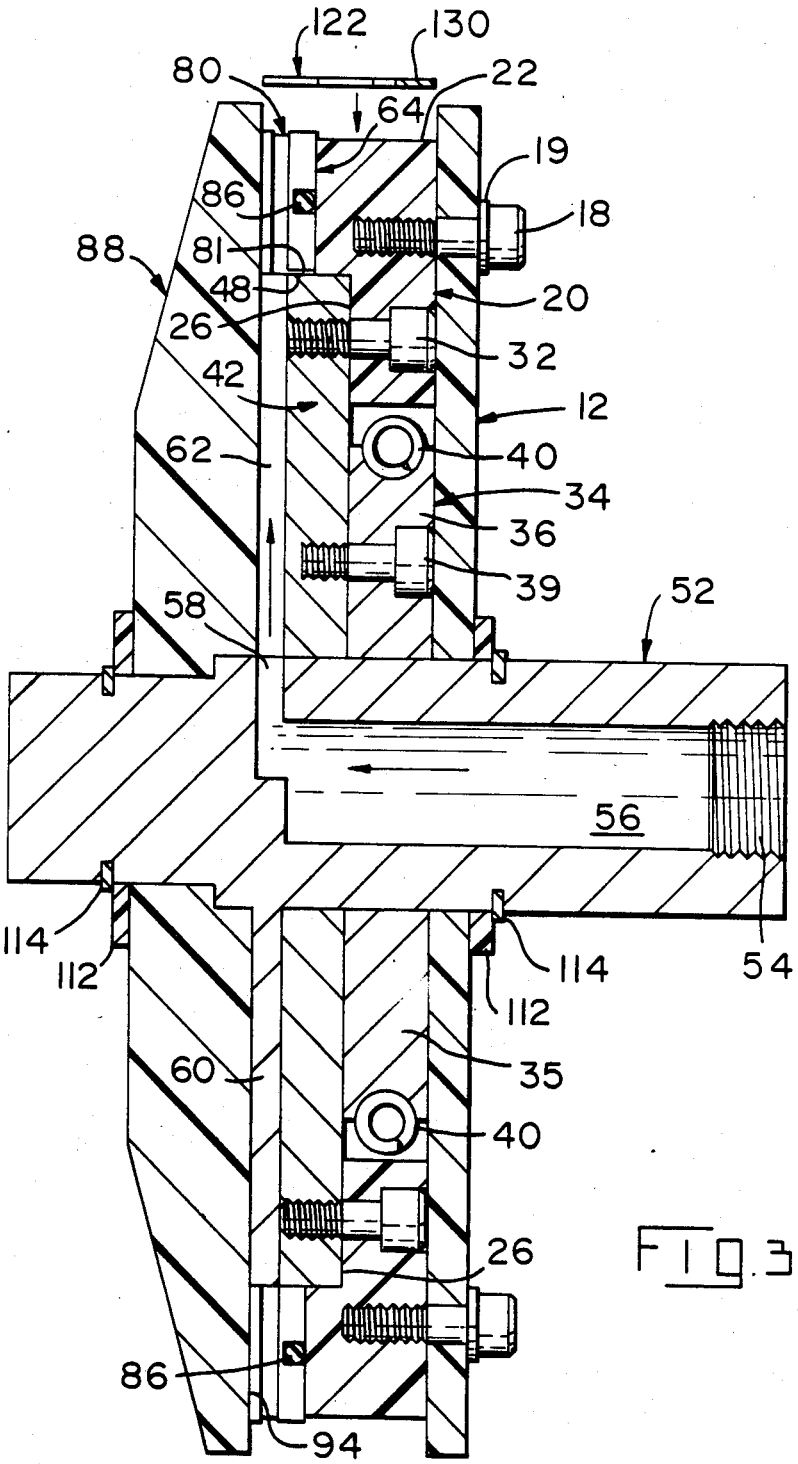
FIG. 3 is a cross-sectional view of the apparatus taken along lines 3—3 of FIG. 2.

FIGS. 1, 2 and 3 illustrate a mandrel apparatus 10 according to the invention comprising an assembly of an insulated disk flange 12, insulated support plate 20, a conductive bushing 34, conductive anode plate 42, a plurality of anode extensions 64 and an insulative wheel shaped flange 88 which are mounted for rotation around conductive shaft 52. The parts are held on shaft 52 by retaining means such as clips and washers 114, 112, respectively. As is best seen in FIG. 2, assembled apparatus is attached to mounting surface 132, such as plating tank, by attaching shaft 52 with mounting means (not shown), such that shaft 52 remains stationary during the plating operation.

As is shown in FIG. 2, terminal strip 120 comprised of a plurality of terminals 122 integral with and serially spaced along carrier strip 130 is fed to the apparatus 10. Strip 120 is partially wrapped against mandrel apparatus 10 and fed from the mandrel apparatus 10. The strip is held against mandrel 10 by means of tension belt 134 which passes through a series of pulleys 136. Tension belt 134 holds the wrapped portion of strip 120 against the surface of mandrel apparatus 10 during the plating process.

Figure 5:
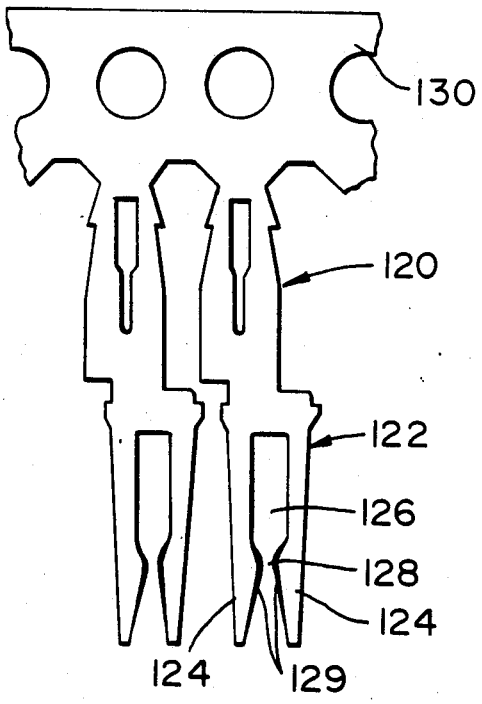
FIG. 5 is a fragmentary plan view of the strip of terminals plated in accordance with the invention.
Figure 6:
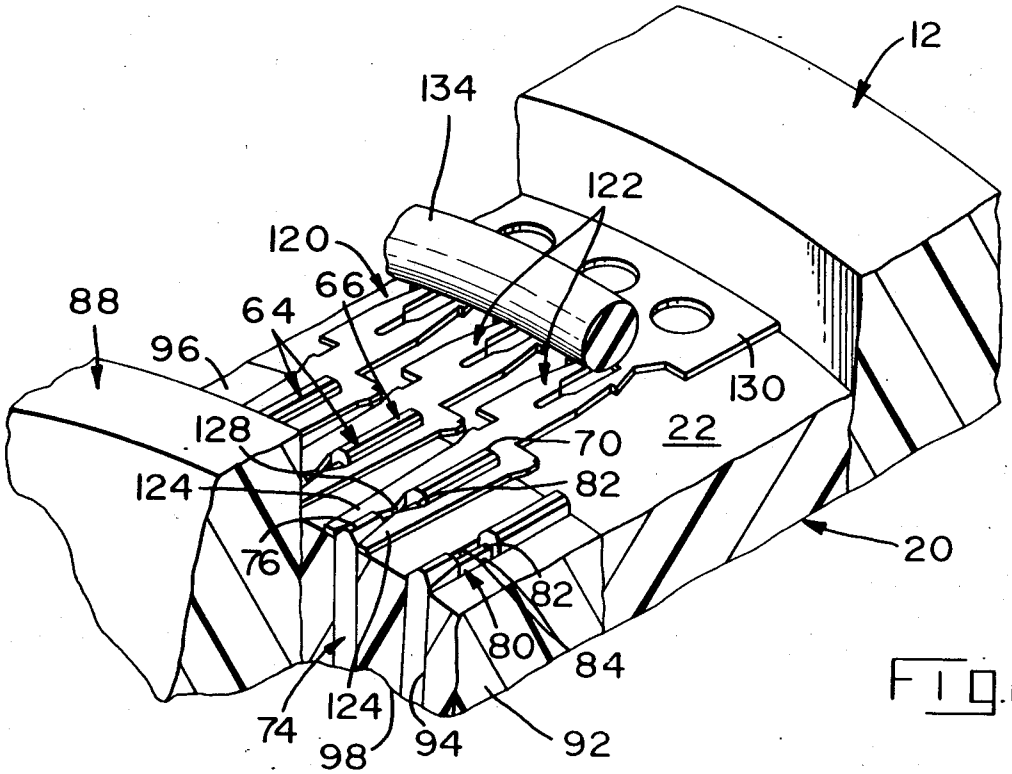
FIG. 6 is an enlarged fragmentary perspective view of a portion of the apparatus taken along line 6—6 of in FIG. 2.

For purposes of illustrating the invention, terminal strip 120 is shown in FIGS. 5 and 6 as a strip of forked terminals 122. Terminals 122, which are attached to carrier strip 130, are comprised of two tines 124 separated by slot 126 and having contact zone 128. FIG. 5 also shows a plated layer 129 deposited in accordance with the invention on contact zone 128. The selectively plated layer is generally a noble metal or noble metal alloy or a plurality of layers of such metals. The deposit of metal plated in accordance with the invention has observable characteristics that distinguish from characteristics of plating by other means known in the art. By using the apparatus of the present invention it is possible to deposit plating thicknesses of 15 microinches and greater directly to the interior contact zone of flat terminals with the exterior surfaces of the terminals being substantially free of the noble metal plating. It is to be understood that the shape and center line spacing of the terminals may be changed and that the apparatus can be modified accordingly to accommodate a variety of essentially flat terminals.

FIGS. 1 and 3 illustrate details of the parts and assembly of mandrel apparatus 10. In the preferred embodiment, insulative parts 12, 20 and 88 are advantageously machined from a high density polyvinylchloride. Other materials as known in the art may also be used. The conductive parts 34, 42 and 52 are preferably made of stainless steel. The various parts are assembled with bolts 18, 32 and 39 as will be described more fully below.

Insulative flange 12 has aperture 14 therein for mounting flange 12 onto shaft 52, and a plurality of apertures 16 therein for receiving bolt 18 when apparatus 10 is assembled. Insulative terminal support plate 20 has aperture 24 therein, dimensioned to receive contact ring 34, and an inner annular recess 26 dimensioned to receive anode plate 42, as best seen in FIG. 3 and shown in phantom in FIG. 1. The peripheral surface of plate 20 provides a terminal support surface 22 for strip 120 of electrical terminals 122 during the plating process. Plate 20 further has a first plurality of apertures 28 for receiving bolts 18 and a second plurality of apertures 30 for receiving anode attaching bolts 32 used for attaching anode plate 42 to support plate 20.

Conductive bushing 34 preferably is comprised of first part 35 and second part 36, first part 35 having a plurality of apertures 37 therein for mounting assembled bushing 34 to conductive anode plate 42. Bushing retaining means 40, preferably a stainless steel spring member holds first and second bushing parts 35, 36 respectively against each other and against shaft 52 in the assembled apparatus. Preferably the mating surfaces of parts 35 and 36 are designed to have a slight gap between them which is closed by retaining means 40. This ensures good contact between bushing parts 35 and 36 and with shaft 52. Assembled bushing 34 is mounted to anode plate 42 by bolts 39 which extend through corresponding apertures 37 and 45 in conductive bushing 34 and anode plate 42, respectively. Bushing 34 and anode 42 have apertures 38 and 44 respectively dimensioned to engage shaft 52. Anode plate 42 further has anode extension engagement surface 48, and apertures 46 for receiving anode attaching bolts 32 when terminal support plate 20 is attached to the assembled anode plate 42 and bushing 34.

Conductive shaft 52 has mounting means 54 for mounting shaft 52 in a stationary position on support surface 132 such as a plating tank as shown in FIG. 2. Referring again to FIGS. 1 and 3, shaft 52 is provided with a central electrolyte conduit 56 which extends along a portion of its length. A channel shaped electrolyte manifold 58 is recessed in a portion of the cylindrical periphery of shaft 52 essentially at the inner end of conduit 56. A semicircular valve plate 60 extends outwardly from a remaining portion of the cylindrical periphery of shaft 52 at the inner end of conduit 56 and in alignment with electrolyte manifold 58.

Figure 4:
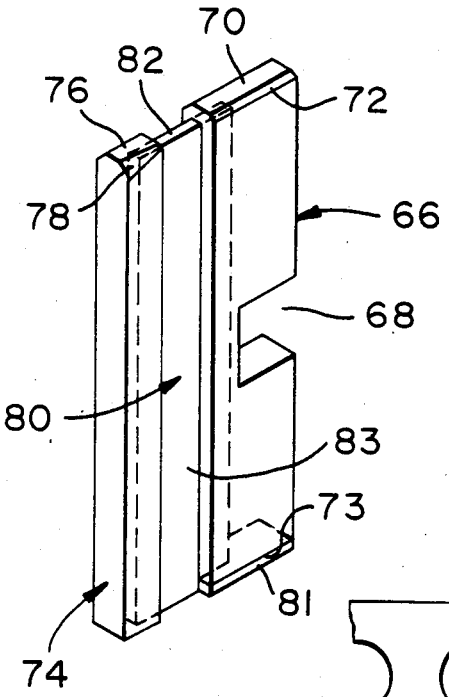
FIG. 4 is an enlarged perspective view of the anode extension of the apparatus as shown in FIG. 1.

FIG. 4 illustrates the details of anode extensions 64. Anode extensions 64 are comprised of a first dielectric portion 66, a second dielectric portion 74, and a metal portion 80. First dielectric portion 66 has a slot 68 therein for receiving anode extension retaining ring 86 in the assembled apparatus. The first and second dielectric portions 66, 74 have front faces 70, 76. Preferably the front edges are chamfered at 72 and 78 to assist in aligning the interior of terminals 122 on anode extension 64. Metal portion 80 extends along and is inserted between first and second dielectric portions 66, 74 such that first and second dielectric members extend slightly beyond the front edge 82 and side edges 83 of metal portion 80. Side edges of metal strip 80 extend into dielectric portions 66, 74 (shown in phantom). Metal portion 80 has a tab 81 extending from one of sides 83, which extends along rear face 73 of first dielectric member 66. The length of first dielectric member 66 is slightly less than that of second dielectric member 74 to accommodate tab 81 so that the end of second dielectric member 74 essentially lies in the same plane as tab 81.

Preferably dielectric portions 66 and 74 are molded over the stamped member 80. The preferred metal is platinum.

Dielectric flange 88, as shown in FIGS. 1 and 3, has aperture 90 therein for mounting to shaft 52. Flange 88 is further comprised of an anode extension support ring 92 having radially spaced slots 94 therein for receiving anode extensions 64, mounting surface 96 for receiving terminals 122, inner ring surface 98, and a slot 100 for receiving the retaining ring 86.

In assembling apparatus 10, insulative flange 88 is mounted to the solid portion of shaft 58 by inserting shaft 52 through aperture 90 and is held in place at 55 by locking clip 114 and washer 112, such that the valve plate 60 lies against essentially half of the anode extension support ring, as is best seen in FIG. 3. After attaching bushing 34 to anode plate 42, as previously described, the combined unit is mounted on shaft 52 by inserting conduit end of shaft 52 through apertures 44 and 38 of plate 42 and bushing 34 respectively. Anode extensions 64 are then inserted into slots 94 of anode extension support ring 92 such that the front faces 70, 76, 82 of first and second dielectric portions and metal portion respectively extend slightly beyond the mounting surface 96, as is best seen in FIG. 6. The inner edges of anode extensions 64 lie substantially flush with inner ring surface 98 and against anode plate 42, as is seen in FIG. 3. FIG. 6 also shows electrolyte channels 84 formed on either side of metal portions 80 of anode extensions 64 by the walls of support ring 92. Anode extension retaining ring 86 is inserted into the slots 68 and 100 of anode extensions 64 and retaining ring 92 respectively, to hold the anode extensions 64 securely in the anode support ring 92 and tabs 81 of anode extensions 64 in mechanical contact and electrical engagement with anode extension engagement surface 48 of anode plate 42.

The remaining parts 20 and 12 of apparatus 10 are mounted to the shaft 52. Support plate 20 is mounted on shaft 52 so that bushing 34 is positioned within aperture 24 of plate 20 and anode plate 42 is positioned in annular recess 26 of plate 20. Plate 20 is attached to anode plate 42 by bolts 32 inserted through apertures 30 and 46 in support plate 20 and anode plate 42 respectively. Insulative flange 12 is then mounted on shaft 52 and attached to support plate 20 by means of bolts 18 which pass through washer 19, and apertures 16, 28 of flange 12 and support plate 20, respectively. These parts are retained in place on shaft 52 at 53 by means of washer 112 and clip 114.

When the parts are assembled as is best shown in FIG. 3, a portion of anode plate 42 is spaced from a portion of anode extension support ring 92 of flange 88 by a distance equal to the thickness of the valve plate 60, thus forming nozzles 62 which are in alignment with electrolyte outlet 58 in conduit 56 of shaft 52. When electrolytic solution is pumped, under pressure, into conduit 56, the solution passes through outlet 58 into nozzles 62 and along electrolyte channels 84 along sides 83 of metal portions 80 of anode extensions 64. As mandrel apparatus 10 is rotated about the shaft 52, anode extensions 64 having terminals 122 mounted thereon, are sequentially brought into alignment with open nozzles 62. Shaft 52 is mounted such that valve plate 60 closes off the nozzles 62 which are not in alignment with terminals and, thus, not in the plating zone.

As terminal strip 120 is fed onto apparatus 10, as best seen in FIG. 6, terminals 122 are aligned with and engage corresponding anode extensions 64, with front face 82 of metal portions 80 being in alignment with terminal contact surface 128. Chamfered edges 72, 78 of anode extensions 64 aid in engagement terminal 122 over anode extensions 64. Terminals 122 are held against mandrel apparatus 10 by belt 134. As can be seen from FIGS. 3 and 6, the edges of flanges 12 and 88 extend outwardly beyond the terminal support surface 22 of portion 20 and surface 94 of anode support ring 92 respectively, to hold the terminal strip 120 in alignment in the apparatus 10.

In operation, driving means (not shown) rotate the mandrel apparatus 10 and feeding means feed terminal strip 120 onto the mandrel 10. Electrolyte solution is supplied under pressure into the conduit 56 of the shaft 52. An electrical potential from the source E is applied between the anode plate 42 and the strip fed terminals 122 to produce a current I. Terminals 122 serve as a cathode onto which noble or precious or semi-precious metal ions of the electrolyte solution are to be plated. Upon rotation of mandrel 10 each of nozzles 62 communicates with the electrolyte outlet 58. The electrolyte flows from conduit 56 through the nozzle 62, along passageways 83 and over the metal ends 82 of anode extensions 64 which lie within the interior contact zones 128 of terminals 122. The electrolyte wets the terminal interiors and the anode extensions. Sufficient ion density and current density are present for the ions to deposit as plating upon the surfaces of the terminal interiors. The proximity of the anode extension ends 82 to the contact surfaces 128 assure that the surfaces of the terminal interiors are plated rather than the other terminal surfaces. Excess electrolyte will flow past anode extension 64 and will be returned to the plating bath. As the mandrel is further rotated the nozzles successively become disconnected from alignment with electrolyte manifold 58, terminals 122 are removed from anode extensions 64 and plating deposition ceases.

The invention has been described by way of examples only. It is to be understood that other types of flat terminals may be plated in accordance with the invention. Dimensional changes in the strip of terminals, such as center line spacing of the terminals, the width of the strip of terminals and location of the contact surface can be accommodated easily by corresponding dimensional changes in the spacing and size of the anode extensions and the distance between the outwardly spaced flanges.

It is thought that the plating apparatus of the present invention and many of its attendant advantages will be understood from the foregoing description. It will be apparent that various changes may be made in the form, construction and arrangement of the parts thereof without departing from the spirit or scope of the invention or sacrificing all its material advantages.

What is claimed is:

1. An apparatus for plating interior contact surfaces of electrical terminals that are spaced apart and attached to a carrier strip, comprising:

a mandrel continuously rotated as strip fed electrical terminals are continuously fed to the mandrel, partially wrapped against the mandrel and exited from the mandrel;

a plurality of nozzles distributed about the mandrel's axis of rotation;

a plurality of anode extensions associated with and in communication with an anode, said plurality of anode extensions being mounted within said nozzles such that a portion of each said anode extension extends outwardly from an outer end of said nozzle;

aligning means to align said electrical terminals as they are wrapped against said mandrel, such that each of said terminals is aligned with one of said nozzles and mounted over one of said anode extensions, said anode extension being in alignment with the interior contact surface of said terminal;

a conduit supplying plating solution under pressure through the nozzles and upon the anode extensions and into the interiors of the terminals mounted on said anode extensions; and a source of electrical potential for supplying electrical current flow from the anode and anode extensions through the plating solution and into the interiors of the terminals mounted on said anode extensions, thereby plating said interior contact surfaces of said terminals.

2. The apparatus as described in claim 1 wherein said mandrel is rotatably mounted on a stationary shaft, the periphery of said shaft including an electrolyte manifold that communicates with the conduit and a portion of said plurality of nozzles, said nozzles being successively brought into communication with said electrolyte manifold upon revolution of said mandrel about said shaft.

3. The apparatus as described in claim 1 wherein said shaft further includes a valve plate which blocks flow of plating solution to nozzles not in alignment with said terminals.

4. The apparatus as described in claim 1 wherein each of said anode extensions is comprised of a conductive member and first and second dielectric portions.

5. The apparatus as described in claim 4 wherein said first and second dielectric portions have chamfered leading edges for aiding in alignment and mounting of the terminals over said anode extensions.

6. A process for plating interior contact surfaces of electrical terminals that are spaced apart and attached to a carrier strip, comprising the steps of:

continuously rotating a mandrel, said mandrel having a plurality of nozzles distributed about its axis of rotation and a plurality of anode extensions associated with and in communication with an anode, said plurality of anode extensions being mounted within said nozzles such that a portion of each said anode extension extends outwardly from an outer end of said nozzle;

continuously feeding a strip of electrical terminals to said mandrel;

partially wrapping said terminals against said mandrel;

aligning said electrical terminals as they are wrapped against said mandrel, such that each of said wrapped terminals is aligned with one of said nozzles and mounted over one of said anode extensions, said anode extension being in alignment with the interior contact surface of said terminal;

supplying plating solution under pressure through the nozzles and upon the anode extensions and into the interiors of the terminals mounted on said anode extensions; and providing a source of electrical potential for supplying electrical current flow from the anode and anode extensions through the plating solution and into the interiors of the terminals mounted on said anode extensions, thereby plating said interior contact surfaces of said terminals.

7. The process for plating interior contact surfaces of electrical terminals as described in claim 6 further comprising the step of continuously removing said strip of terminals from said mandrel after they are plated.

* * * * *